US005341394A

United States Patent [19]

Nicetto

[11] Patent Number: 5,341,394

[45] Date of Patent: Aug. 23, 1994

[54] FURNACE FOR MELTING MATERIALS WITH LOW MELTING POINT WITH IMPROVED CASTING DUCT

[75] Inventor: Romeo Nicetto, Senago, Italy

[73] Assignee: Nicem S.r.l., Milan, Italy

[21] Appl. No.: 937,031

[22] Filed: Aug. 31, 1992

[51] Int. Cl.[5] ..... F27D 3/00

[52] U.S. Cl. ..... 373/115; 373/33; 373/79; 373/142; 164/485

[58] Field of Search ..... 373/115, 116–118, 373/109, 119, 122, 127, 146, 142, 79, 85, 111, 120, 33, 35; 164/51, 80, 82, 119, 485; 75/13, 43, 46

[56] References Cited

U.S. PATENT DOCUMENTS

| | | | |
|---|---|---|---|
| 916,314 | 3/1909 | Hitt | 373/115 |
| 2,756,988 | 7/1956 | Tama | 373/115 |
| 3,948,643 | 4/1976 | Fredriksson et al. | 75/13 |
| 3,985,177 | 10/1976 | Buehler | 164/51 |
| 4,621,676 | 11/1986 | Steward | 164/485 |

*Primary Examiner*—Bruce A. Reynolds
*Assistant Examiner*—Tu Hoang
*Attorney, Agent, or Firm*—Guido Modiano; Albert Josif; Daniel O'3 Byrne

[57] ABSTRACT

The furnace for melting materials with a low melting point with improved casting duct comprises a furnace body which surrounds a crucible for containing the molten material and which is provided with first resistors for heating the crucible, the casting duct having an inlet arranged above the level of the free surface of the molten material in the crucible and being fed by a ladle for removing molten material, the casting duct being further provided with second resistors for heating thereof in order to prevent accidental cooling of the molten material along the duct.

15 Claims, 2 Drawing Sheets

FURNACE FOR MELTING MATERIALS WITH LOW MELTING POINT WITH IMPROVED CASTING DUCT

BACKGROUND OF THE INVENTION

The present invention relates to a furnace for melting materials with low melting point, both metals or metallic alloys and synthetic materials, with improved casting duct.

Machines for forming parts by means of the centrifugal casting of metals or metallic alloys or synthetic materials with low melting point are known. These machines generally comprise a mold which is constituted by two flat elements made of vulcanized rubber which are mutually coupled at one of their respective faces and in which the forming cavities are defined.

The forming cavities are connected, by means of appropriate ducts defined in the two flat elements, to a central feed duct into which the molten material, which must fill the forming cavities, is poured. During the introduction of the molten material, the mold is rotated about the common axis of the two plates, which is generally vertical, so that the molten material fills the forming cavities, reproducing even the smallest details with extreme precision.

This type of machine can be supplied with molten material either manually or directly by means of a furnace which is arranged above the machine.

Furnaces currently intended for this use generally comprise a cylindrical body made of refractory material which surrounds a crucible intended to contain the molten material. Inside the body of the furnace, around the crucible, there are electric resistors or other sources of heating, for example gas- or gas oil-powered ones, for heating the crucible. The molten material is conveyed to the forming machine through a substantially vertical casting duct which is defined in the body of the furnace laterally to the crucible.

The casting duct has an inlet which is arranged above the level of the free surface of the molten material, which is fed to the casting duct by means of an extraction ladle which can move vertically in the crucible, Said known types of melting furnaces have some problems.

In fact, the casting duct is generally defined in a region of the furnace which is not affected, except indirectly, by the electric resistors which heat the crucible, and thus the molten material, while traveling along the casting duct, can progressively cool until it obstructs the casting duct, requiring the intervention of an operator to restore the correct flow of material toward the forming machine.

In order to avoid as much as possible occlusions of the casting duct, the material is kept in the crucible at a temperature which is significantly higher than its melting point.

Although this solution is effective, it requires the use of particular alloys which are more expensive and increases the forming of slag in the molten material.

SUMMARY OF THE INVENTION

The aim of the present invention is to obviate the problems described above by providing a furnace with an improved casting duct which prevents solidification of the molten material without however requiring excessive temperatures in the crucible.

Within the scope of this aim, an object of the invention is to provide a furnace which, by being able to operate with temperatures which are only slightly higher than the melting point of the material to be fed to the forming machine, can use less expensive materials with a minimum forming of slag and thus with improved results as regards the formed parts, or can in any case use more expensive alloys but work at lower temperatures, with advantages in product quality and in better use of the molds.

Another object of the invention is to provide a furnace which, by avoiding the occlusion of the casting duct, significantly reduces the frequency of maintenance interventions.

Another object of the invention is to provide a furnace with a casting duct which is simple to manufacture with commonly available components.

This aim, these objects and others which will become apparent hereinafter are achieved by a furnace for melting materials with a low melting point with improved casting duct, which comprises a furnace body which surrounds a crucible for containing the molten material, first crucible heating means being provided in said furnace body, said casting duct having an inlet arranged above the level of the free surface of the molten material in the crucible, means being furthermore provided for feeding the molten material to said casting duct, characterized in that it comprises second means for heating said casting duct.

BRIEF DESCRIPTION OF THE DRAWINGS

Further characteristics and advantages will become apparent from the detailed description of a furnace according to the invention, illustrated only by way of non-limitative example in the accompanying drawings, wherein.

DESCRIPTION OF THE PREFERRED EMBODIMENTS

Figure 1:
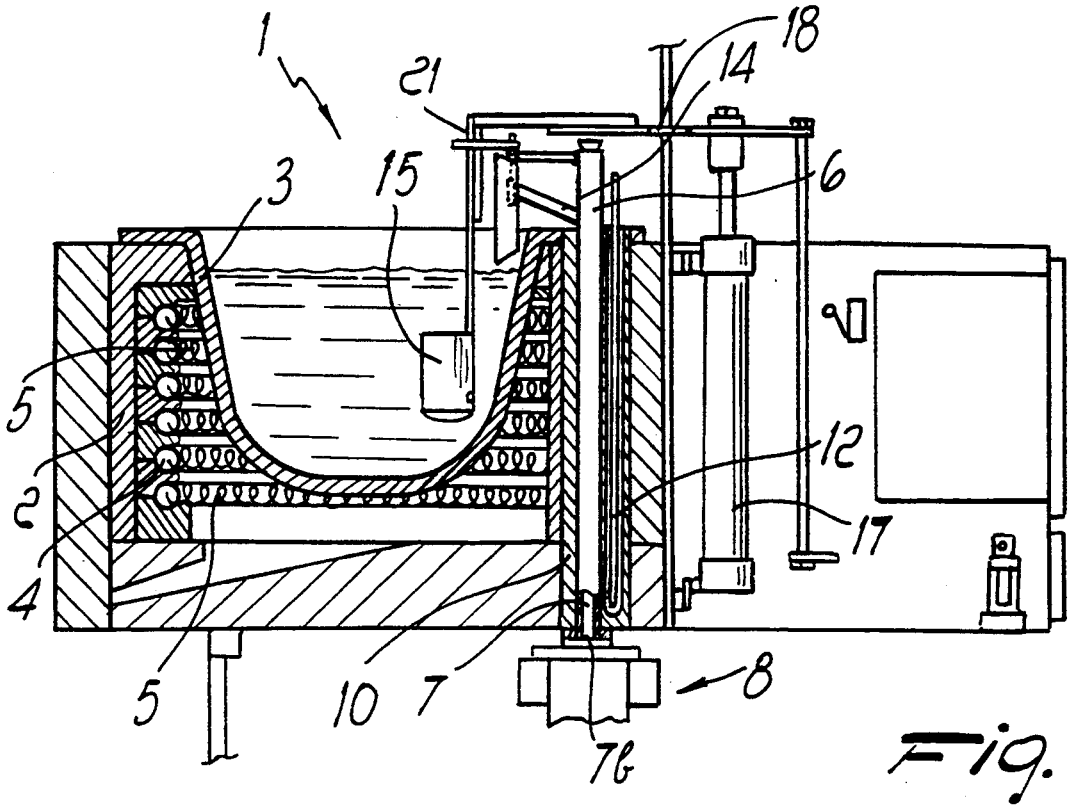
FIGS. 1 and 2 are axial sectional views of the furnace according to the invention.
Figure 2:
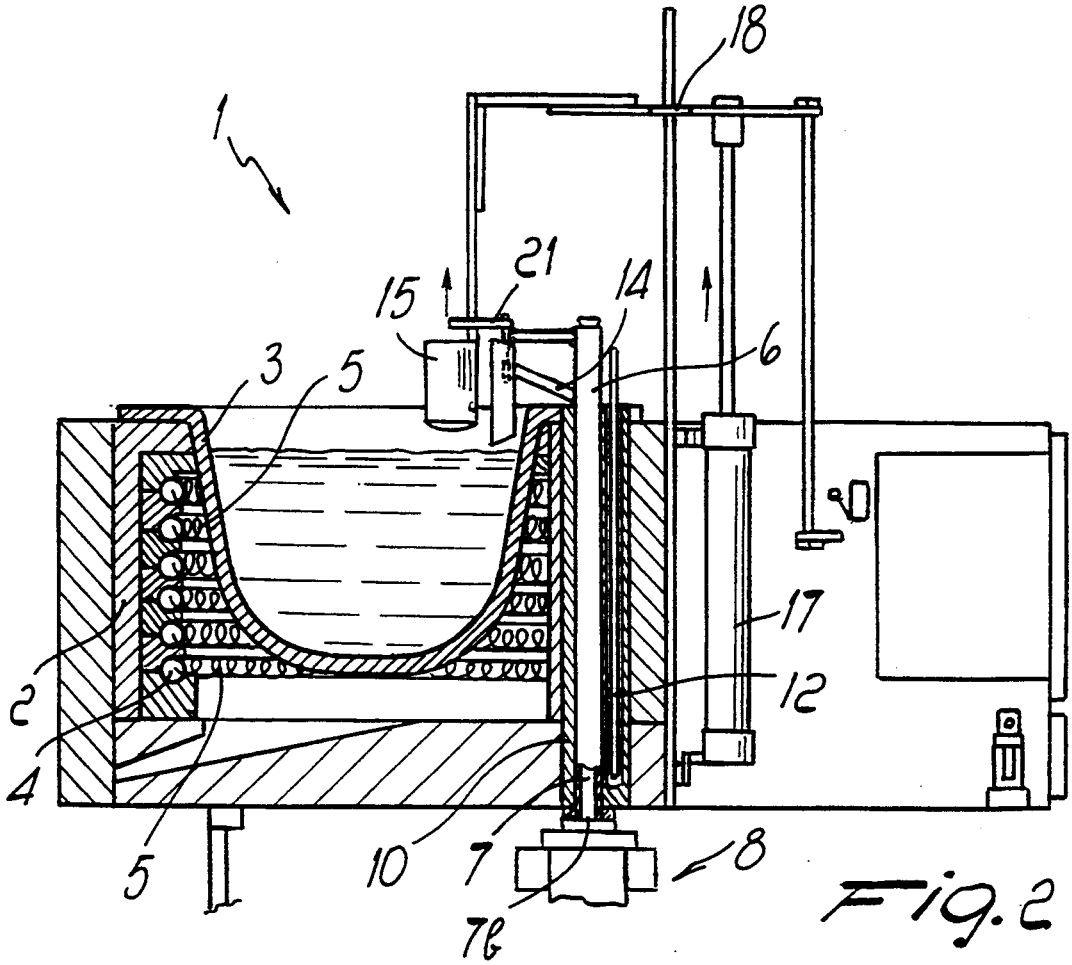

With reference to the above figures, the furnace according to the invention, generally designated by the reference numeral 1, comprises a furnace body 2 which has a substantially cylindrical shape, which is made of refractory material and which surrounds a crucible 3 for containing the molten material. Circumferential seats 4 for first crucible heating means, constituted by electric resistors 5, are defined on the wall of the body 2 which is directed toward said crucible 3.

A substantially vertical tubular body 6 is arranged laterally to the crucible 3 and has formed therein a through-passage defining a casting duct 7.

Figure 5:
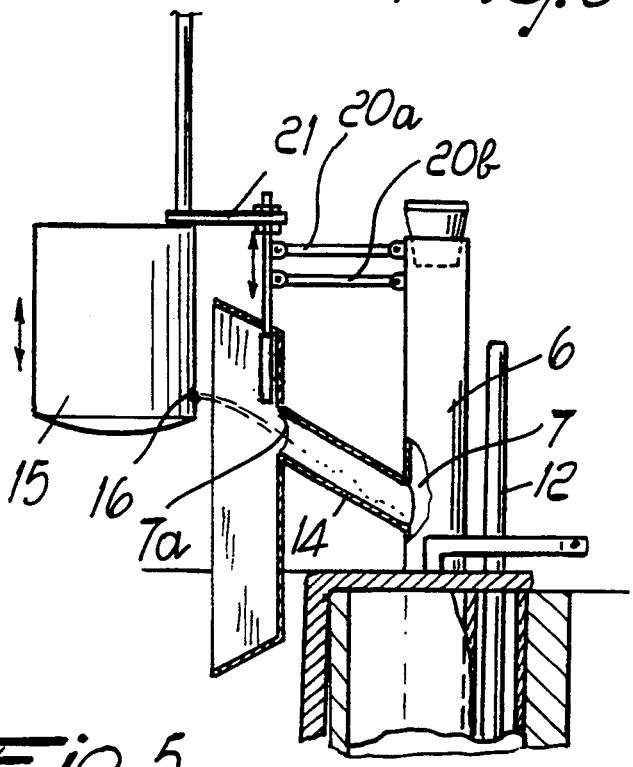
FIG. 5 is a sectional view of FIG. 3, taken along the plane V—V, illustrating the feed of the casting duct.

The casting duct 7 is provided with an inlet **7*a* (FIG. 5) which is arranged above the level of the free surface of the liquid material inside the crucible 3, and with an outlet 7*b* which feeds by gravity a known forming machine 8** arranged below the furnace.

According to the invention, there are second means for heating the casting duct which are conveniently constituted by an electric resistor 9 embedded in a cylindrical block 10 made of heat-conducting material which surrounds the tubular body 6.

Figure 4:
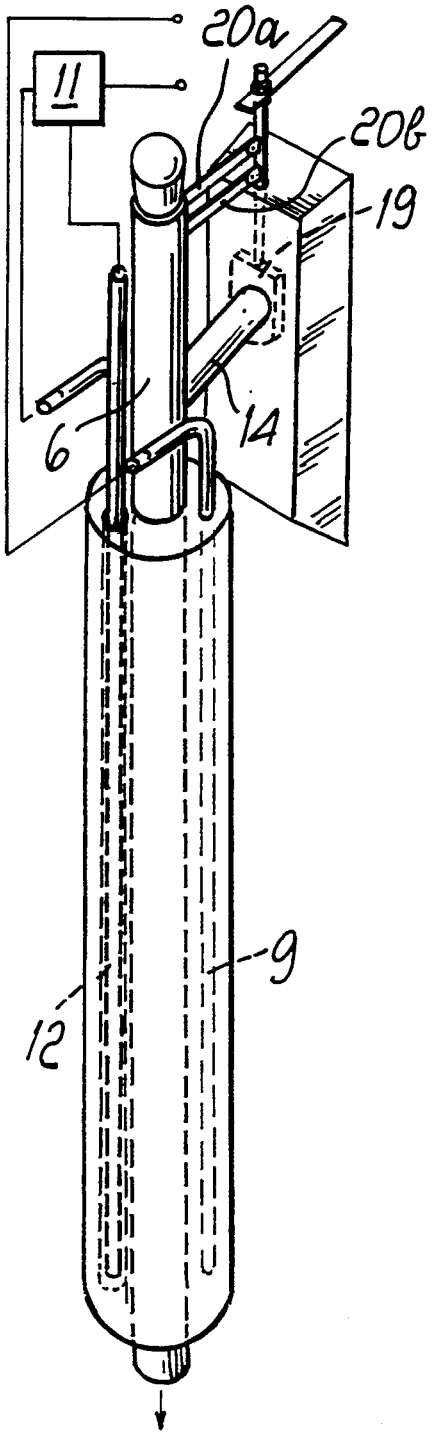
FIG. 4 is a perspective view of the casting duct with the second heating means.
Figure 3:
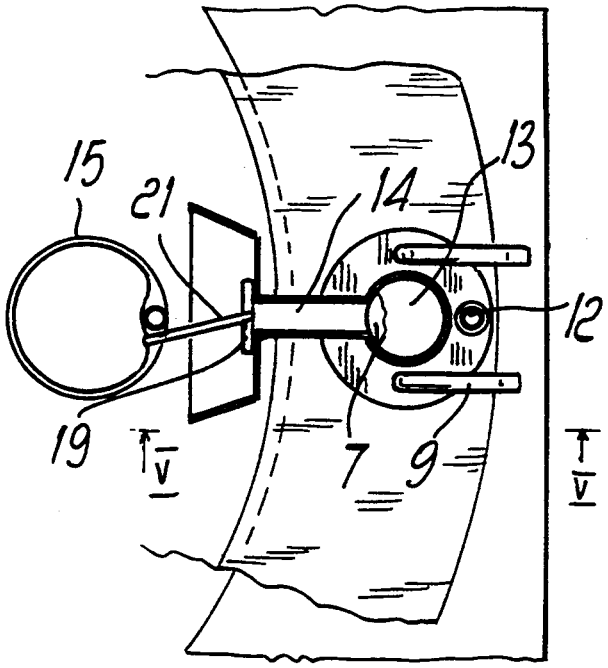
FIG. 3 is an enlarged-scale top plan view of a portion of the furnace at the casting duct.

Advantageously, there are also means for controlling the temperature of the casting duct, constituted by a thermostat 11 (FIG. 4) which is placed on the circuit which supplies electric power to the resistor 9 and which is provided with a probe 12 inserted in the block 10. The thermostat 11 cuts off the supply of electric power to the resistor 9 when the temperature of the block 10, i.e. of the casting duct, reaches a preset value, so that the temperature of the casting duct is always such as to avoid solidification of the material.

The tubular duct 6 extends vertically, and its upper end is closed by a plug 13 which can be removed for possible inspections or interventions for maintenance of the casting duct.

The inlet *7a* is defined on a lateral branch 14 of the casting duct, and the furnace is provided with means for or transferring the molten material to the casting duct.

The feed means are constituted by a ladle 15 which is located in the crucible 3 and which can move vertically in order to remove an amount of molten material and raise it up to the inlet *7a*. The ladle 15 is provided with a hole 16 which, when said ladle rises, can be arranged at, or slightly above, the inlet *7a* so that the molten material can flow out of said ladle by gravity into the casting duct 7.

The lifting and lowering of the ladle 15 are obtained by means of a pneumatic cylinder 17 which has a vertical axis, which is arranged outside the furnace and which is connected to the ladle by means of a transverse rod 18.

Conveniently, in order to avoid the escape of fumes, which might cause a sudden cooling of the molten material, along the casting duct 7, there are means for closing the inlet *7a* which are operatively connected to the ladle 15.

The closure means comprise a plate 19 which is articulated, by means of a pair of connecting rods 20*a* and 20*b*, to the tubular body 6. The plate 19 can thus move vertically from a closure position, in which it faces the inlet *7a*, to an opening position, in which it is raised above the inlet *7a*. The plate 19 is furthermore provided with an actuation rod 21 which extends upward and is touched by the ladle 15 in the last part of its rising movement, thus causing the opening of the inlet *7a* in order to allow the flow of the molten material into the casting duct.

In practice it has been observed that the furnace with the casting duct according to the invention fully achieves the intended aim, since, by avoiding solidification of the material it avoids interruptions in the operating cycle of the furnace and allows to operate with lower temperatures than conventional furnaces.

A further advantage which arises from the reduction of the operating temperature of the furnace is that it allows significant energy saving.

In practice, the materials employed, as well as the dimensions, may be any according to the requirements and the state of the art.

I claim:

1. Furnace for melting materials with a low melting point having an improved casting duct, said furnace comprising;

a crucible for containing molten material introduced therein up to a surface level;

a furnace body surrounding said crucible;

first heating means for heating said crucible provided in said furnace body;

a casting duct;

an inlet defined by said casting duct above said surface level of molten material in said crucible;

feeding means for transferring molten material from said crucible to said casting duct;

second heating means for heating said casting duct, and;

control means for controlling temperature of said casting duct;

wherein said second heating means comprise;

a substantially cylindrical block made of heat-conducting material and surrounding said casting duct, and;

an electric resistor embedded in said substantially cylindrical block.

2. Furnace according to claim 1, wherein said control means comprise a thermostat having a probe, said probe being inserted in said substantially cylindrical block, said thermostat controlling power supplied to said electric resistor whereby to maintain said casting duct at a preset temperature.

3. Furnace according to claim 1, wherein said casting duct extends substantially vertically and has an upper end and a lateral branch, said furnace further comprising a movable plug, said upper end being closed by said removable plug, said inlet being defined in said lateral branch.

4. Furnace according to claim 1, wherein said furnace further comprises a plate, said plate being arranged in front of said inlet for closing said casting duct, said feeding means comprising a ladle movable vertically within said crucible for raising molten material to said inlet, said plate being connected to said ladle for movement between a closure position, whereat said plate is located at said inlet, and an opening position, whereat said plate is arranged above said inlet.

5. Furnace for melting materials having a low melting point comprising;

a crucible for containing material to be melted;

a furnace body surrounding said crucible;

first heating means for heating said furnace body;

a substantially vertical tubular body arranged laterally of said crucible, said tubular body having formed therein a through passage, said through passage defining a casting duct having an inlet;

second heating means for heating said tubular body, and;

means for transferring molten metal from said crucible to said casting duct.

6. Furnace according to claim 5, wherein said casting duct has a lateral branch and an upper end, said upper end being closed by a removable plug, said inlet being formed in said lateral branch above said crucible.

7. Furnace according to claim 5, wherein said means for transferring molten metal from said crucible to said casting duct comprise;

a vertically movable ladle;

means for moving said ladle between a lowered position, whereat molten material contained in said crucible flows into said ladle, and a raised position, whereat said ladle is proximate to said inlet, and;

means for moving molten material from said ladle to said inlet.

8. Furnace according to claim 6, wherein said means for moving molten material from said ladle to said inlet comprise at least one hole formed in said ladle, said hole being locatable proximate to said inlet with said ladle in said raised position, whereby to allow molten material to flow by gravity from said ladle, through said hole and into said inlet of said casting duct.

9. Furnace according to claim 5, wherein said first heating means comprise circumferential seats formed in said furnace body, and electric resistors accommodated in said circumferential seats, and wherein said second heating means comprise at least one electric resistor connected to said casting duct, circuit means for supplying electric power to said electric resistor, and thermostat means connected to said circuit means.

10. Furnace according to claim 9, wherein said electric resistor connected to said casting duct is embedded in a heat-conducting block, said heat-conducting block surrounding said tubular body.

11. Furnace according to claim 10, wherein said heat-conducting block comprises a substantially cylindrical block made of heat-conducting material, said electric resistor connected to said casting duct being embedded in said cylindrical block, said thermostat means being connected to a probe, said probe being embedded in said substantially cylindrical block.

12. Furnace according to claim 5, further comprising means for closing said inlet operatively connected to said ladle.

13. Furnace according to claim 12, wherein said means for closing said inlet comprise connecting rods articulated to said tubular body, a plate articulated to said connecting rods, and an actuation rod fixed to said plate and upwardly displaced by said ladle in said raised position thereof.

14. Furnace for melting materials having a low melting point comprising;

a crucible for containing material to be melted;

a furnace body surrounding said crucible;

first heating means for heating said furnace body;

a substantially vertical tubular body arranged laterally of said crucible;

a through passage formed in said tubular body;

a casting duct defined by said through passage, said casting duct having a lateral branch, and an inlet, said inlet being formed in said lateral branch above said crucible;

second heating means for heating said tubular body;

a vertically movable ladle;

means for moving said ladle between a lowered position, whereat molten material contained in said crucible flows into said ladle, and a raised position, whereat said ladle is proximate to said inlet, and;

outflow means formed in said ladle and locatable proximate to said inlet with said ladle in said raised position, whereby to allow molten material to flow by gravity from said ladle and into said inlet.

15. Furnace according to claim 14, wherein said outflow means comprise at least one hole formed in said ladle, and wherein said means for closing said inlet comprise;

connecting rods articulated to said tubular body;

a plate articulated to said connecting rods, and;

an actuation rod fixed to said plate and upwardly displaced by said ladle in said raised position thereof.

* * * * *